US006074502A

United States Patent [19]

Burns et al.

[11] Patent Number: 6,074,502

[45] **Date of Patent: *Jun. 13, 2000**

[54] SMOKELESS GAS GENERANT COMPOSITIONS

[75] Inventors: Sean P. Burns, Auburn Hills; Paresh S. Khandhadia, Troy, both of Mich.

[73] Assignee: Automotive Systems Laboratory, Inc., Farmington Hills, Mich.

[ * ] Notice: This patent is subject to a terminal disclaimer.

[21] Appl. No.: 09/250,944

[22] Filed: Feb. 16, 1999

Related U.S. Application Data

[63] Continuation-in-part of application No. 08/745,949, Nov. 8, 1996, Pat. No. 5,872,329.

[60] Provisional application No. 60/077,652, Mar. 11, 1998.

[51] Int. Cl.[7] ..... C06B 31/28; C06B 31/36

[52] U.S. Cl. ..... 149/36; 149/46; 149/47

[58] Field of Search ..... 149/36, 46

[56] References Cited

U.S. PATENT DOCUMENTS

| | | | |
|---|---|---|---|
| 3,912,561 | 10/1975 | Doin et al. | 149/35 |
| 5,386,755 | 2/1995 | Poole et al. | 149/36 |
| 5,557,062 | 9/1996 | MacLaren et al. | 149/46 |
| 5,756,929 | 5/1998 | Lundstrom et al. | 149/36 |
| 5,872,329 | 2/1999 | Burns et al. | 149/36 |
| 5,962,808 | 10/1999 | Lundstrom | 149/19.1 |
| 6,007,647 | 12/1999 | Burns et al. | 149/36 |

*Primary Examiner*—Charles T. Jordan
*Assistant Examiner*—Glenda L. Sánchez
*Attorney, Agent, or Firm*—Lyon, P.C.

[57] ABSTRACT

Thermally stable gas generant compositions incorporate a combination of one or more primary nonazide high-nitrogen fuels selected from a group including tetrazoles, bitetrazoles, and triazoles, and salts thereof; and one or more secondary nonazide high nitrogen fuels selected from azodicarbonamide and hydrazodicarbonamide. The primary and secondary fuels are combined with phase-stabilized ammonium nitrate that when combusted, results in a greater yield of gaseous products per mass unit of gas generant, a reduced yield of solid combustion products, lower combustion temperatures, and acceptable burn rates, thermal stability, and ballistic properties. These compositions are especially suitable for inflating air bags in passenger-restraint devices.

7 Claims, 2 Drawing Sheets

SMOKELESS GAS GENERANT COMPOSITIONS

CROSS REFERENCE TO RELATED APPLICATIONS

This is a continuation-in-part of U.S. application Ser. No. 08/745,949 filed on Nov. 8, 1996, now U.S. Pat. No. 5,872,329, now allowed. This application also claims the benefit of U.S. Provisional Application Serial No. 60/077,652 filed on Mar. 11, 1998.

FIELD OF THE INVENTION

The present invention relates to nontoxic gas generating compositions which upon combustion, rapidly generate gases that are useful for inflating occupant safety restraints in motor vehicles and specifically, the invention relates to thermally stable nonazide gas generants having not only acceptable burn rates, but that also, upon combustion, exhibit a relatively high gas volume to solid particulate ratio at acceptable flame temperatures.

BACKGROUND OF THE INVENTION

The evolution from azide-based gas generants to nonazide gas generants is well-documented in the prior art. The advantages of nonazide gas generant compositions in comparison with azide gas generants have been extensively described in the patent literature, for example, U.S. Pat. Nos. 4,370,181; 4,909,549; 4,948,439; 5,084,118; 5,139,588 and 5,035,757, the discussions of which are hereby incorporated by reference.

In addition to a fuel constituent, pyrotechnic nonazide gas generants contain ingredients such as oxidizers to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable clinker-like particulates. Other optional additives, such as burning rate enhancers or ballistic modifiers and ignition aids, are used to control the ignitability and combustion properties of the gas generant.

One of the disadvantages of known nonazide gas generant compositions is the amount and physical nature of the solid residues formed during combustion. The solids produced as a result of combustion must be filtered and otherwise kept away from contact with the occupants of the vehicle. It is therefore highly desirable to develop compositions that produce a minimum of solid particulates while still providing adequate quantities of a nontoxic gas to inflate the safety device at a high rate.

The use of phase stabilized ammonium nitrate is desirable because it generates abundant nontoxic gases and minimal solids upon combustion. To be useful, however, gas generants for automotive applications must be thermally stable when aged for 400 hours or more at 107° C. The compositions must also retain structural integrity when cycled between−40° C. and 107° C.

Often, gas generant compositions incorporating phase stabilized or pure ammonium nitrate exhibit poor thermal stability, and produce unacceptably high levels of toxic gases, CO and $NO_x$ for example, depending on the composition of the associated additives such as plasticizers and binders. In addition, ammonium nitrate contributes to poor ignitability, lower burn rates, and performance variability.

Several known gas generant compositions incorporating ammonium nitrate utilize well known ignition aids such as $BKNO_3$ to solve this problem. However, the addition of an ignition aid such as $BKNO_3$ is undesirable because it is a highly sensitive and energetic compound, and furthermore, contributes to thermal instability and an increase in the amount of solids produced.

Certain gas generant compositions comprised of ammonium nitrate are thermally stable, but have burn rates less than desirable for use in gas inflators. To be useful for passenger restraint inflator applications, gas generant compositions generally require a burn rate of at least 0.4 inch/second (ips) or more at 1000 psi. Gas generants with burn rates of less than 0.40 ips at 1000 psi do not ignite reliably and often result in "no-fires" in the inflator.

Yet another problem that must be addressed is that the U.S. Department of Transportation (DOT) regulations require "cap testing" for gas generants. Because of the sensitivity to detonation of fuels often used in conjunction with ammonium nitrate, most propellants incorporating ammonium nitrate do not pass the cap test unless shaped into large disks, which in turn reduces design flexibility of the inflator.

Many nonazide gas generants burn at temperatures well-above known azide-based gas generants. To simplify cooling requirements, a nonazide gas generant composition suitable for use in an airbag inflator would be an improvement.

Finally, gas generant compositions as disclosed in co-owned and copending U.S. application Ser. Nos. 08/745,949 and 08/851,503 are suitable for use within an automotive airbag inflator. However, certain combustion characteristics respective to certain gas generant compositions can be improved. For example, compositions containing PSAN, nitroguanidine, and a nonmetal salt of a tetrazole are disadvantaged by a shortened burn time and a higher combustion temperature as compared to the compositions of the present invention.

DESCRIPTION OF THE RELATED ART

A description of related art follows, the complete teachings of which are herein incorporated by reference.

U.S. Pat. No. 5,545,272 to Poole discloses the use of gas generant compositions consisting of nitroguanidine (NQ), at a weight percent of 35%–55%, and phase stabilized ammonium nitrate (PSAN) at a weight percent of 45%–65%. NQ, as a fuel, is preferred because it generates abundant gases and yet consists of very little carbon or oxygen, both of which contribute to higher levels of CO and NOx in the combustion gases. According to Poole, the use of phase stabilized ammonium nitrate (PSAN) or pure ammonium nitrate is problematic because many gas generant compositions containing the oxidizer are thermally unstable. Poole has found that combining NQ and PSAN in the percentages given results in thermally stable gas generant compositions. However, Poole reports burn rates of only 0.32–0.34 inch per second, at 1000 psi. As is well known, burn rates below 0.4 inch per second at 1000 psi are simply too low for confident use within an inflator.

In U.S. Pat. No. 5,531,941 to Poole, Poole teaches the use of PSAN, and two or more fuels selected from a specified group of nonazide fuels. Poole adds that gas generants using ammonium nitrate (AN) as the oxidizer are generally very slow burning with burning rates at 1000 psi typically less than 0.1 inch per second. He further teaches that for air bag applications, burning rates of less than about 0.4 to 0.5 inch per second are difficult to use. The use of PSAN is taught as desirable because of its propensity to produce abundant gases and minimal solids, with minimal noxious gases. Nevertheless, Poole recognizes the problem of low burn rates and thus combines PSAN with a fuel component containing a majority of TAGN, and if desired one or more additional fuels. The addition of TAGN increases the burn rate of ammonium nitrate mixtures. According to Poole, TAGN/PSAN compositions exhibit acceptable burn rates of 0.59–0.83 inch/per second. TAGN, however, is a sensitive explosive that poses safety concerns in processing and handling. In addition, TAGN is classified as "forbidden" by the Department of Transportation, therefore complicating raw material requirements.

In U.S. Pat. No. 5,500,059 to Lund et al., Lund states that burn rates in excess of 0.5 inch per second (ips) at 1,000 psi, and preferably in the range of from about 1.0 ips to about 1.2 ips at 1,000 psi, are generally desired. Lund discloses gas generant compositions comprised of a 5-aminotetrazole fuel and a metallic oxidizer component. The use of a metallic oxidizer reduces the amount of gas liberated per gram of gas generant, however, and increases the amount of solids generated upon combustion.

The gas generant compositions described in Poole et al, U.S. Pat. Nos. 4,909,549 and 4,948,439, use tetrazole or triazole compounds in combination with metal oxides and oxidizer compounds (alkali metal, alkaline earth metal, and pure ammonium nitrates or perchlorates) resulting in a relatively unstable generant that decomposes at low temperatures. Significant toxic emissions and particulate are formed upon combustion. Both patents teach the use of $BKNO_3$ as an ignition aid.

The gas generant compositions described in Poole, U.S. Pat. No. 5,035,757, result in more easily filterable solid products but the gas yield is unsatisfactory.

Chang et al, U.S. Pat. No. 3,954,528, describes the use of TAGN and a synthetic polymeric binder in combination with an oxidizing material. The oxidizing materials include pure AN although, the use of PSAN is not suggested. The patent teaches the preparation of propellants for use in guns or other devices where large amounts of carbon monoxide, nitrogen oxides, and hydrogen are acceptable and desirable. Because of the practical applications involved, thermal stability is not considered a critical parameter.

Grubaugh, U.S. Pat. No. 3,044,123, describes a method of preparing solid propellant pellets containing AN as the major component. The method requires use of an oxidizable organic binder (such as cellulose acetate, PVC, PVA, acrylonitrile and styrene-acrylonitrile), followed by compression molding the mixture to produce pellets and by heat treating the pellets. These pellets would certainly be damaged by temperature cycling because commercial ammonium nitrate is used, and the composition claimed would produce large amounts of carbon monoxide.

Becuwe, U.S. Pat. No. 5,034,072, is based on the use of 5-oxo-3-nitro-1,2,4-triazole as a replacement for other explosive materials (HMX, RDX, TATB, etc.) in propellants and gun powders. This compound is also called 3-nitro-1,2,4-triazole-5-one ("NTO"). The claims appear to cover a gun powder composition which includes NTO, AN and an inert binder, where the composition is less hygroscopic than a propellant containing ammonium nitrate. Although called inert, the binder would enter into the combustion reaction and produce carbon monoxide making it unsuitable for air bag inflation.

Lund et al, U.S. Pat. No. 5,197,758, describes gas generating compositions comprising a nonazide fuel which is a transition metal complex of an aminoarazole, and in particular are copper and zinc complexes of 5-aminotetrazole and 3-amino-1,2,4-triazole which are useful for inflating air bags in automotive restraint systems, but generate excess solids.

Wardle et al, U.S. Pat. No. 4,931,112, describes an automotive air bag gas generant formulation consisting essentially of NTO (5-nitro-1,2,4-triazole-3-one) and an oxidizer wherein said formulation is anhydrous.

Ramnarace, U.S. Pat. No. 4,111,728, describes gas generators for inflating life rafts and similar devices or that are useful as rocket propellants comprising ammonium nitrate, a polyester type binder and a fuel selected from oxamide and guanidine nitrate. Ramnarace teaches that ammonium nitrate contributes to burn rates lower than those of other oxidizers and further adds that ammonium nitrate compositions are hygroscopic and difficult to ignite, particularly if small amounts of moisture have been absorbed.

Bucerius et al, U.S. Pat. No. 5,198,046, teaches the use of diguanidinium-5,5'-azotetrazolate (GZT) with $KNO_3$ as an oxidizer, for use in generating environmentally friendly, non-toxic gases. Bucerius teaches away from combining GZT with any chemically unstable and/or hygroscopic oxidizer. The use of other amine salts of tetrazole such as bis-(triaminoguanidinium)-5,5'-azotetrazolate (TAGZT) or aminoguanidinium-5,5'-azotetrazolate are taught as being much less thermally stable when compared to GZT.

Boyars, U.S. Pat. No. 4,124,368, describes a method for preventing detonation of ammonium nitrate by using potassium nitrate.

Mishra, U.S. Pat. No. 4,552,736, and Mehrotra et al, U.S. Pat. No. 5,098,683, describe the use of potassium fluoride to eliminate expansion and contraction of ammonium nitrate in transition phase.

Chi, U.S. Pat. No. 5,074,938, describes the use of phase stabilized ammonium nitrate as an oxidizer in propellants containing boron and as useful in rocket motors.

In U.S. Pat. No. 5,125,684 to Cartwright, an extrudable propellant for use in crash bags is described as comprising an oxidizer salt, a cellulose-based binder and a gas generating component. Cartwright also teaches the use of "at least one energetic component selected from nitroguanidine (NG), triaminoguanidine nitrate, ethylene dinitramine, cyclotrimethylenetrinitramine (RDX), cyclotetramethylenetetranitramine (HMX), trinitrotoluene (TNT), and pentaerythritol tetranitrate (PETN) . . . "

In U.S. Pat. No. 4,925,503 to Canterbury et al, an explosive composition is described as comprising a high energy material, e.g., ammonium nitrate and a polyurethane polyacetal elastomer binder, the latter component being the focus of the invention. Canterbury also teaches the use of a "high energy material useful in the present invention . . . preferably one of the following high energy materials: RDX, NTO, TNT, HMX, TAGN, nitroguanidine, or ammonium nitrate . . . "

Hass, U.S. Pat. No. 3,071,617, describes long known considerations as to oxygen balance and exhaust gases.

Stinecipher et al, U.S. Pat. No. 4,300,962, describes explosives comprising ammonium nitrate and an ammonium salt of a nitroazole.

Prior, U.S. Pat. No. 3,719,604, describes gas generating compositions comprising aminoguanidine salts of azotetrazole or of ditetrazole.

Poole, U.S. Pat. No. 5,139,588, describes nonazide gas generants useful in automotive restraint devices comprising a fuel, an oxidizer and additives.

Hendrickson, U.S. Pat. No. 4,798,637, teaches the use of bitetrazole compounds, such as diammonium salts of bitetrazole, to lower the burn rate of gas generant compositions. Hendrickson describes burn rates below 0.40 ips, and an 8% decrease in the burn rate when diammonium bitetrazole is used.

Chang et al, U.S. Pat. No. 3,909,322, teaches the use of nitroaminotetrazole salts with oxidizers such as pure ammonium nitrate, HMX, and 5-ATN. These compositions are used as gun propellants and gas generants for use in gas pressure actuated mechanical devices such as engines, electric generators, motors, turbines, pneumatic tools, and rockets. In contrast to the amine salts disclosed by Hendrickson, Chang teaches that gas generants comprised of 5-aminotetrazole nitrate and salts of nitroaminotetrazole exhibit burn rates in excess of 0.40 ips. On the other hand, Chang also teaches that gas generants comprised of HMX and salts of nitroaminotetrazole exhibit burn rates of 0.243 ips to 0.360 ips. No data is given with regard to burn rates associated with pure AN and salts of nitroaminotetrazole.

Highsmith et al, U.S. Pat. No. 5,516,377, teaches the use of a salt of 5-nitraminotetrazole, NQ, a conventional ignition aid such as $BKNO_3$, and pure ammonium nitrate as an oxidizer, but does not teach the use of phase stabilized ammonium nitrate. Highsmith states that a composition comprised of ammonium nitraminotetrazole and strontium nitrate exhibits a burn rate of 0.313 ips. This is to low for automotive application. As such, Highsmith emphasizes the use of metallic salts of nitraminotetrazole.

Poole et al., U.S. Pat. No. 5,386,775, teaches the use of low energy fuels including hydrazodicarbonamide and azodicarbonamide to reduce the combustion temperature of a propellant. However, Poole states that it is necessary to use an alkali metal salt of an organic acid to obtain an acceptable burn rate. This would create higher levels of solids.

Onishi et al, U.S. Pat. No. 5,439,251, teaches the use of a tetrazole amine salt as an air bag gas generating agent comprising a cationic amine and an anionic tetrazolyl group having either an alkyl with carbon number 1–3, chlorine, hydroxyl, carboxyl, methoxy, aceto, nitro, or another tetrazolyl group substituted via diazo or triazo groups at the 5-position of the tetrazole ring. The inventive thrust is to improve the physical properties of tetrazoles with regard to impact and friction sensitivity, and therefore does not teach the combination of an amine or nonmetal tetrazole salt with any other chemical.

Lund et al, U.S. Pat. No. 5,501,823, teaches the use of nonazide anhydrous tetrazoles, derivatives, salts, complexes, and mixtures thereof, for use in air bag inflators. The use of bitetrazole-amines, not amine salts of bitetrazoles, is also taught.

SUMMARY OF THE INVENTION

The aforementioned problems are solved by a nonazide gas generant for a vehicle passenger restraint system comprising phase stabilized ammonium nitrate, one or more primary nonazide fuels, and one or more secondary nonazide fuels selected from azodicarbonamide and hydrazodicarbonamide. The present compositions burn at lower combustion temperatures and at greater burn rates. With regard to manufacturing, azodicarbonamide improves the flow properties of PSAN-based compositions. Furthermore, it acts as a lubricant and reduces the friction when compressed tablets are ejected from a die.

The primary nonazide fuels are selected from a group including tetrazole-containing compounds such as 5,5'bitetrazole, diammonium bitetrazole, diguanidinium-5,5'-azotetrazolate (GZT), and nitrotetrazoles such as 5-nitrotetrazole; triazoles such as nitroaminotriazole, nitrotriazoles, and 3-nitro-1,2,4 triazole-5-one; and salts of tetrazoles and triazoles.

A preferred primary fuel(s) is selected from the group consisting of amine and other nonmetal salts of tetrazoles and triazoles having a nitrogen containing cationic component and a tetrazole and/or triazole anionic component. The anionic component comprises a tetrazole or triazole ring, and an R group substituted on the 5-position of the tetrazole ring, or two R groups substituted on the 3- and 5-positions of the triazole ring. The R group(s) is selected from hydrogen and any nitrogen-containing compounds such as amino, nitro, nitramino, tetrazolyl and triazolyl groups. The cationic component is formed from a member of a group including amines, aminos, and amides including ammonia, hydrazine, guanidine compounds such as guanidine, aminoguanidine, diaminoguanidine, triaminoguanidine, dicyandiamide, nitroguanidine, nitrogen substituted carbonyl compounds such as urea, carbohydrazide, oxamide, oxamic hydrazide, bis-(carbonamide) amine, azodicarbonamide, and hydrazodicarbonamide, and, amino azoles such as 3-amino-1,2,4-triazole, 3-amino-5-nitro-1,2,4-triazole, 5-aminotetrazole and 5-nitraminotetrazole. Optional inert additives such as clay, alumina, or silica may be used as a binder, slag former, coolant or processing aid. Optional ignition aids comprised of nonazide propellants may also be utilized in place of conventional ignition aids such as $BKNO_3$.

DETAILED DESCRIPTION OF THE PREFERRED EMBODIMENT(S)

Figure 1:
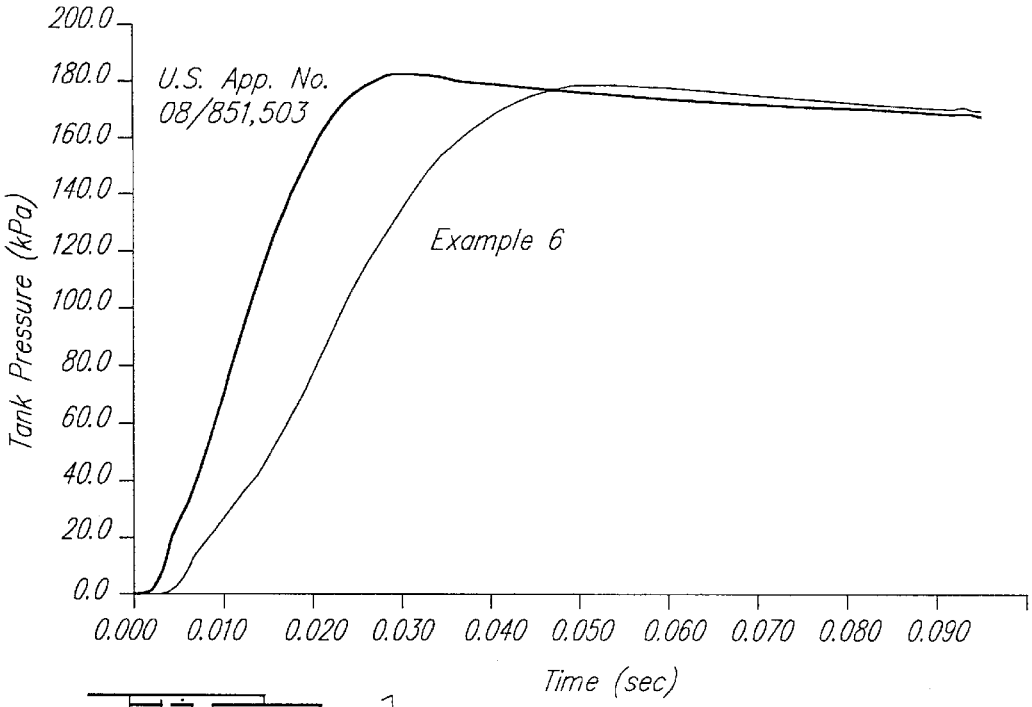
FIG. 1 represents the results of a 60 L tank test comparing the compositions of the present invention with those of U.S. application Ser. No. 08/851,503.

A nonazide gas generant comprises phase stabilized ammonium nitrate (PSAN), one or more primary nonazide high-nitrogen fuels, and one or more secondary nonazide high-nitrogen fuels selected from the group including azodicarbonamide (ADCA) and hydrazodicarbonamide (AH).

One or more primary nonazide high-nitrogen fuels are selected from a group including tetrazoles and bitetrazoles such as 5-nitrotetrazole and 5,5'-bitetrazole; triazoles and nitrotriazoles such as nitroaminotriazole and 3-nitro-1,2,4 triazole-5-one; nitrotetrazoles; and salts of tetrazoles and salts of triazoles.

More specifically, salts of tetrazoles include in particular, amine, amino, and amide nonmetal salts of tetrazole and triazole selected from the group including monoguanidinium salt of 5,5'-Bis-1H-tetrazole (BHT.1GAD), diguanidinium salt of 5,5'-Bis-1H-tetrazole (BHT.2GAD), monoaminoguanidinium salt of 5,5'-Bis-1H-tetrazole (BHT.1AGAD), diaminoguanidinium salt of 5,5'-Bis-1H-tetrazole (BHT.2AGAD), monohydrazinium salt of 5,5'-Bis-1H-tetrazole (BHT.1HH), dihydrazinium salt of 5,5'-Bis-1H-tetrazole (BHT.2HH), monoammonium salt of 5,5'-bis-1H-tetrazole (BHT.1$NH_3$), diammonium salt of 5,5'-bis-1H-tetrazole (BHT.2$NH_3$), mono-3-amino-1,2,4-triazolium salt of 5,5'-bis-1H-tetrazole (BHT.1ATAZ), di-3-amino-1,2,4-triazolium salt of 5,5'-bis-1H-tetrazole (BHT.2ATAZ), and diguanidinium salt of 5,5'-Azobis-1H-tetrazole (ABHT.2GAD).

Amine salts of triazoles include monoammonium salt of 3-nitro-1,2,4-triazole ($NTA \cdot 1NH_3$), monoguanidinium salt of 3-nitro-1,2,4-triazole (NTA·1GAD), diammonium salt of dinitrobitriazole ($DNBTR \cdot 2NH_3$), diguanidinium salt of dinitrobitriazole (DNBTR·2GAD), and monoammonium salt of 3,5-dinitro-1,2,4-triazole ($DNTR \cdot 1NH_3$).

Formula I

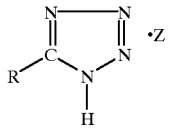

Formula II

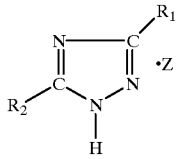

A generic nonmetal salt of tetrazole as shown in Formula I includes a cationic nitrogen containing component, Z, and an anionic component comprising a tetrazole ring and an R group substituted on the 5-position of the tetrazole ring. A generic nonmetal salt of triazole as shown in Formula II includes a cationic nitrogen containing component, Z, and an anionic component comprising a triazole ring and two R groups substituted on the 3- and 5-positions of the triazole ring, wherein $R_1$ may or may not be structurally synonymous with $R_2$. An R component is selected from a group including hydrogen or any nitrogen-containing compound such as an amino, nitro, nitramino, or a tetrazolyl or triazolyl group as shown in Formula I or II, respectively, substituted directly or via amine, diazo, or triazo groups. The compound Z is substituted at the 1-position of either formula, and is formed from a member of the group comprising amines, aminos, and amides including ammonia, carbohydrazide, oxamic hydrazide, and hydrazine; guanidine compounds such as guanidine, aminoguanidine, diaminoguanidine, triaminoguanidine, dicyandiamide and nitroguanidine; nitrogen substituted carbonyl compounds or amides such as urea, oxamide, bis-(carbonamide) amine, azodicarbonamide, and hydrazodicarbonamide; and, amino azoles such as 3-amino-1,2,4-triazole, 3-amino-5-nitro-1,2,4-triazole, 5-aminotetrazole, 3-nitramino-1,2,4-triazole, 5-nitraminotetrazole, and melamine.

In accordance with the present invention, a preferred gas generant composition results from the mixture of one or more primary nonazide high-nitrogen fuels comprising 5%–45%, and more preferably 9%–27% by weight of the gas generant composition; one or more secondary nonazide high-nitrogen fuels comprising 1%–35%, and more preferably 1%–15% by weight of the gas generant composition; and PSAN comprising 55%–85%, and more preferably 66%–78% by weight of the gas generant composition. Tetrazoles are more preferred than triazoles due to a higher nitrogen and lower carbon content thereby resulting in a higher burning rate and lower carbon monoxide. Salts of tetrazoles are even more preferred because of superior ignition stability. As taught by Onishi, U.S. Pat. No. 5,439,251, herein incorporated by reference, salts of tetrazoles are much less sensitive to friction and impact thereby enhancing process safety. Nonmetallic salts of bitetrazoles are more preferred than nonmetallic salts of tetrazoles due to superior thermal stability. As also taught by Onishi, nonmetallic salts of bitetrazoles have higher melting points and higher exothermal peak temperatures thereby resulting in greater thermal stability when combined with PSAN. The diammonium salt of bitetrazole is most preferred because it is produced in large quantities and readily available at a reasonable cost.

In accordance with procedures well known in the art, the foregoing primary and secondary nonazide fuels are blended with an oxidizer such as PSAN. The manner and order in which the components of the gas generant compositions of the present invention are combined and compounded is not critical so long as the proper particle size of ingredients are selected to ensure the desired mixture is obtained. The compounding is performed by one skilled in the art, under proper safety procedures for the preparation of energetic materials, and under conditions that will not cause undue hazards in processing nor decomposition of the components employed. For example, the materials may be wet blended, or dry blended and attrited in a ball mill or Red Devil type paint shaker and then pelletized by compression molding. The materials may also be ground separately or together in a fluid energy mill, sweco vibroenergy mill or bantam micropulverizer and then blended or further blended in a v-blender prior to compaction.

Compositions having components more sensitive to friction, impact, and electrostatic discharge should be wet ground separately followed by drying. The resulting fine powder of each of the components may then be wet blended by tumbling with ceramic cylinders in a ball mill jar, for example, and then dried. Less sensitive components may be dry ground and dry blended at the same time.

Phase stabilized ammonium nitrate is prepared as taught in co-owned U.S. Pat. No. 5,531,941 entitled, "Process For Preparing Azide-free Gas Generant Composition". Other nonmetal inorganic oxidizers such as ammonium perchlorate, or oxidizers that produce minimal solids when combined and combusted with the fuels listed above, may also be used. The ratio of oxidizer to fuel is preferably adjusted so that the amount of oxygen allowed in the equilibrium exhaust gases is less than 3% by weight, and more preferably less than or equal to 2% by weight. The oxidizer comprises 55%–85% by weight of the gas generant composition.

The gas generant constituents of the present invention are commercially available. For example, the amine salts of tetrazoles may be purchased from Toyo Kasei Kogyo Company Limited, Japan. As secondary fuels, azodicarbonamide and hydrazodicarbonamide may be obtained for example from Nippon Carbide in Japan, or from Aldrich Chemical Co., Inc. in Milwaukee, Wis. The components used to synthesize PSAN, as described herein, may be purchased from Fisher or Aldrich. Triazole salts may be synthesized by techniques, such as those described in U.S. Pat. No. 4,236,014 to Lee et al.; in "New Explosives: Nitrotriazoles Synthesis and Explosive Properties", by H. H. Licht, H. Ritter, and B. Wanders, Postfach 1260, D-79574 Weil am Rhein; and in "Synthesis of Nitro Derivatives of Triazoles", by Ou Yuxiang, Chen Boren, Li Jiarong, Dong Shuan, Li Jianjun, and Jia Huiping, *Heterocycles*, Vol. 38, No. 7, pps. 1651–1664, 1994. The teachings of these references are herein incorporated by reference. Other compounds in accordance with the present invention may be obtained as taught in the references incorporated herein, or from other sources well known to those skilled in the art.

An optional burn rate modifier, from 0–10% by weight in the gas generant composition, is selected from a group including an alkali metal, an alkaline earth or a transition metal salt of tetrazoles or triazoles; an alkali metal or alkaline earth nitrate or nitrite; TAGN; dicyandiamide, and alkali and alkaline earth metal salts of dicyandiamide; alkali and alkaline earth borohydrides; or mixtures thereof. An optional combination slag former and coolant, in a range of 0 to 10% by weight, is selected from a group including clay, silica, glass, and alumina, or mixtures thereof. When combining the optional additives described, or others known to those skilled in the art, care should be taken to tailor the additions with respect to acceptable thermal stability, burn rates, and ballistic properties.

In accordance with the present invention, the combination of PSAN, one or more primary nonazide high-nitrogen fuels, and one or more secondary nonazide high-nitrogen fuels as determined by gravimetric procedures, yields beneficial gaseous products equal to or greater than 90% of the total product mass, and solid products equal to or lesser than 10% of the total product mass. Fuels suitable in practicing the present invention are high in nitrogen content and low in carbon content thereby providing a high burn rate and a minimal generation of carbon monoxide.

The synergistic effect of the high-nitrogen fuels, in combination with an oxidizer producing minimal solids when combined with the fuels, results in several long-awaited benefits. Increased gas production per mass unit of gas generant results in the use of a smaller chemical charge. Reduced solids production results in minimized filtration needs and therefore a smaller filter. Together, the smaller charge and smaller filter thereby facilitate a smaller gas inflator system. Furthermore, the gas generant compositions of the present invention have burn rates and ignitability that meet and surpass performance criteria for use within a passenger restraint system, thereby reducing performance variability.

Additionally, the compositions of the present invention are neither explosive nor flammable under normal conditions, and can be transported as non-hazardous chemicals.

The present gas generant compositions have also been found to lower combustion temperatures due to a negative enthalpy of formation. Because the compositions absorb heat upon decomposition, cooling requirements in the filter can be reduced. Table 1 compares certain compositions of the present invention with other compositions containing PSAN. As shown, compositions containing PSAN typically have a high combustion temperature. PSAN10 indicates ammonium nitrate stabilize with 10% by weight potassium nitrate. According to Poole in U.S. Pat. No. 5,386,775 (incorporated herein by reference), the burn rate of the gas generant composition is reduced as the combustion temperature decreases. However, as shown in Examples 2 and 3, when the secondary and primary fuels of the present invention are combined with PSAN (PSAN10=10% by weight KN and PSAN15=15% by weight of KN), the burn rate is still greater than 0.40 inches per second, despite conventional wisdom.

TABLE 1

| Composition | Source | Combustion Temp. at 3000 psi (K) |
|---|---|---|
| 70.46% PSAN10, 16.54% BHT-2NH3, and 13.00% ADCA | Example 2 | 2078 |

TABLE 1-continued

| Composition | Source | Combustion Temp. at 3000 psi (K) |
|---|---|---|
| 67.17% PSAN10, 19.83% BHT-2NH3, and 13.00% NQ | U.S. application Ser. No. 08/851,503 | 2188 |
| 58.2% PSAN10, and 41.8% NQ | Poole 5,534,272 Example 4 | 2423 |
| 64.70% PSAN15, 31.77% TAGN, and 3.53% oxamide | Poole 5,531,941 Example 7 | 2278 |

TABLE 2

| Composition | Source | Tank Pres. at 10 ms | Peak Tank Pressure | Burnout Time | Max Slope |
|---|---|---|---|---|---|
| 70.46% PSAN10 16.54% BHT-2NH3 13.00% ADCA | Example 2 | 27 kPa | 178 kPa | 51 ms | 6.3 kPa/ms |
| 67.17% PSAN10 19.83% BHT-2NH3 13.00% NQ | U.S. app Ser. No. 08/851,503 | 69 kPa | 183 kPa | 30 ms | 10.3 kPa/ms |

To prevent occupant injury, it is most desirable that an inflator slowly generate gas during the initial stages of bag deployment. After an initial slow onset, the inflator must then quickly and completely fill the airbag to provide adequate occupant restraint. In practice, combining a slow inflation onset with a high gas output is difficult at best. One known method combines a dual chamber system within a single inflator. As taught in co-owned and copending U.S. patent application Ser. No. 08/851,503, the addition of nitroguanidine (NQ) to PSAN-based formulations provides tailoring of the ballistic curve as described above. However, nitroguanidine-based PSAN compositions tend to burn out too quickly as shown in FIG. 1. FIG. 1 indicates the maximum tank pressure vs. time curve in a 60 L test tank. As shown in FIG. 1 and Table 2, the compositions of the present invention (exemplified by Example 6) exhibit a slow onset, low slope, and an extended burnout time with no significant change in the overall gas output.

TABLE 3

| Composition | Source | Pressure Range | Pressure Exponent |
|---|---|---|---|
| 70.46% PSAN10, 16.54% BHT-2NH3, and 13.00% ADCA | Example 2 | 0–2200 psi<br>2200–5000 psi | 0.83<br>0.21 |
| 66.34% PSAN10 and 33.66% ADCA | Example 3 | 0–5000 psi | 0.53 |
| 59.0% PSAN10, and 41.0% NQ | Poole 5,545,272; Example 1 | Not Available | 0.47 |

Most propellants follow the equation $R_b aP^n$ where $R_b$ is the linear burn rate, P is pressure, and a and n are constants. The constant n is known as the pressure exponent and characterizes the dependence of the propellant burn rate on pressure. As described by Chi in U.S. Pat. No. 5,074,938 (incorporated herein by reference), the pressure exponent should be as close to zero as possible. As n increases, a very small change in pressure will result in a large change in the burn rate. This could result in high performance or ballistic variability, or over-pressurization. Therefore, for automotive airbag applications, a pressure exponent at about 0.30 or less is desired over the operating pressure of the inflator. Although most burn rates are reported at 1000 psi (6.9 Mpa), the actual operating pressure in most inflators is above 2200 psi. As shown in Table 3 and FIG. 2, the compositions of the present invention (exemplified by Example 6) exhibit a pressure exponent at or below 0.30 at elevated pressures.

Other benefits include the nonexplosive nature and availability of the chemical constituents of the present compositions. Additionally, it has unexpectedly been discovered that the use of ADCA improves the flow properties of PSAN-based compositions. Furthermore, ADCA functions as a lubricant and reduces the friction when compressed tablets are ejected from a die during the manufacturing process.

The present invention is illustrated by the following examples. All compositions are given in percent by weight.

EXAMPLE 1

Comparative Example

A mixture of ammonium nitrate (AN), potassium nitrate (KN), and guanidine nitrate (GN) was prepared having 45.35% $NH_4NO_3$, 8.0% KN, and 46.65% GN. The ammonium nitrate was phase stabilized by coprecipitating with KN at 70–90 degrees Celsius.

The mixture was dry-blended and ground in a ball mill. Thereafter, the dry-blended mixture was compression-molded into pellets. The burn rate of the composition was determined by measuring the time required to burn a cylindrical pellet of known length at constant pressure. The burn rate at 1000 pounds per square inch (psi) was 0.257 inches per second (in/sec); the burn rate at 1500 psi was 0.342 in/sec. The corresponding pressure exponent was 0.702.

EXAMPLE 2

Comparative Example

A mixture of 52.20% $NH_4NO_3$, 9.21% KN, 28.59% GN, and 10.0% 5-aminotetrazole (5AT) was prepared and tested as described in Example 1. The burn rate at 1000 psi was 0.391 in/sec and the burn rate at 1500 psi was 0.515 in/sec. The corresponding pressure exponent was 0.677.

EXAMPLE 3

Comparative Example

Table 4 illustrates the problem of thermal instability when typical nonazide fuels are combined with PSAN:

TABLE 4

Thermal Stability of PSAN - Non-Azide Fuel Mixtures

| Non-Azide Fuel(s) Combined with PSAN | Thermal Stability |
|---|---|
| 5-aminotetrazole (5AT) | Melts with 108C onset and 116C peak. Decomposed with 6.74% weight loss when aged at 107C for 336 hours. Poole '272 shows melting with loss of $NH_3$ when aged at 107C. |
| Ethylene diamine dinitrate, nitroguanidine (NQ) | Poole '272 shows melting at less than 100C |
| 5AT,NQ | Melts with 103C onset and 110C peak. |

TABLE 4-continued

Thermal Stability of PSAN - Non-Azide Fuel Mixtures

| Non-Azide Fuel(s) Combined with PSAN | Thermal Stability |
|---|---|
| 5AT,NQ quanidine nitrate (GN) | Melts with 93C onset on 99C peak. |
| GN, NQ | Melts with 100C onset and 112C. Decomposed with 6.49% weight loss when aged at 107C for 336 hours. |
| GN, 3-nitro-1,2,4-triazole (NTA) | Melts with 108C onset and 110C peak. |
| NQ, NTA | Melts with 111C onset and 113C peak. |
| Aminoguanidine nitrate | Melts with 109C onset and 110C peak. |
| 1H-tetrazole (1HT) | Melts with 109C onset and 110C peak. |
| Dicyandiamide (DCDA) | Melts with 114C onset and 114C peak. |
| GN, DCDA | Melts with 104C onset and 105C peak. |
| NQ, DCDA | Melts with 107C onset and 115C peak. Decomposed with 5.66% weight loss when aged at 107C for 336 hours. |
| 5AT, GN | Melts with 70C onset and 99C peak. |
| Magnesium salt of 5AT (M5AT) | Melts with 100C onset and 111C peak. |

In this example, "decomposed" indicates that pellets of the given formulation were discolored, expanded, fractured, and/or stuck together (indicating melting), making them unsuitable for use in an air bag inflator. In general, any PSAN-nonazide fuel mixture with a melting point of less than 115 C. will decompose when aged at 107 C. As shown, many compositions that comprise well-known nonazide fuels and PSAN are not fit for use within an inflator due to poor thermal stability.

EXAMPLE 4

Comparative Example

A mixture of 56.30% $NH_4NO_3$, 9.94% KN, 17.76% GN, and 16.0% 5AT was prepared and tested as described in Example 1. The burn rate at 1000 psi was 0.473 in/sec and the burn rate at 1500 psi was 0.584 in/sec. The corresponding pressure exponent was 0.518. The burn rate is acceptable, however, compositions containing GN, 5-AT, and PSAN are not thermally stable as shown in Table 4, EXAMPLE 3.

For Examples 5–7, the phase stabilized ammonium nitrate contained 10% KN (PSAN10) and was prepared by corystallization from a saturated water solution at 80 degrees Celsius. The diammonium salt of 5,5'-bis-1H-tetrazole (BHT-2$NH_3$), hydrazodicarbonamide (AH), and azodicarbonamide (ADCA) were purchased from an outside supplier.

EXAMPLE 5

A composition was prepared containing 76.52% PSAN10, 13.48% BHT-2NH3, and 10.00% AH. Each material was dried separately at 105 degrees Celsius. The dried materials were then mixed together and pulverized to a homogeneous powder with a mortar and pestle. The mixture was tested using a differential scanning calorimeter (DSC) and found to melt at about 156 degrees Celsius. The composition was also tested using a thermogravimetric analyzer (TGA) and found to have a 91.8% gas conversion and no mass loss until about 185 degrees Celsius. The DSC and TGA results demonstrate the high thermal stability and high gas yield of this composition.

EXAMPLE 6

A composition was prepared containing 70.46% PSAN10, 16.54% BHT-2NH3, and 13.00 ADCA. Each material was dried separately at 105 degrees Celsius. The dried materials were then mixed together and tumbled with alumina cylinders in a large ball mill jar. After separating the alumina cylinders, the final product resulted in 1500 grams of homogeneous and pulverized powder. The powder was formed into granules to improve flow properties, and then compression molded into pellets (0.184" diameter, 0.090" thick) on a high speed tablet press.

The composition was tested using a DSC and found to melt at about 155 degrees Celsius. The composition was also tested using a TGA and found to have a 91.8% gas conversion and no mass loss until about 170 degrees Celsius. The DSC and TGA results demonstrate the excellent thermal stability and high gas yield of the composition.

Figure 2:
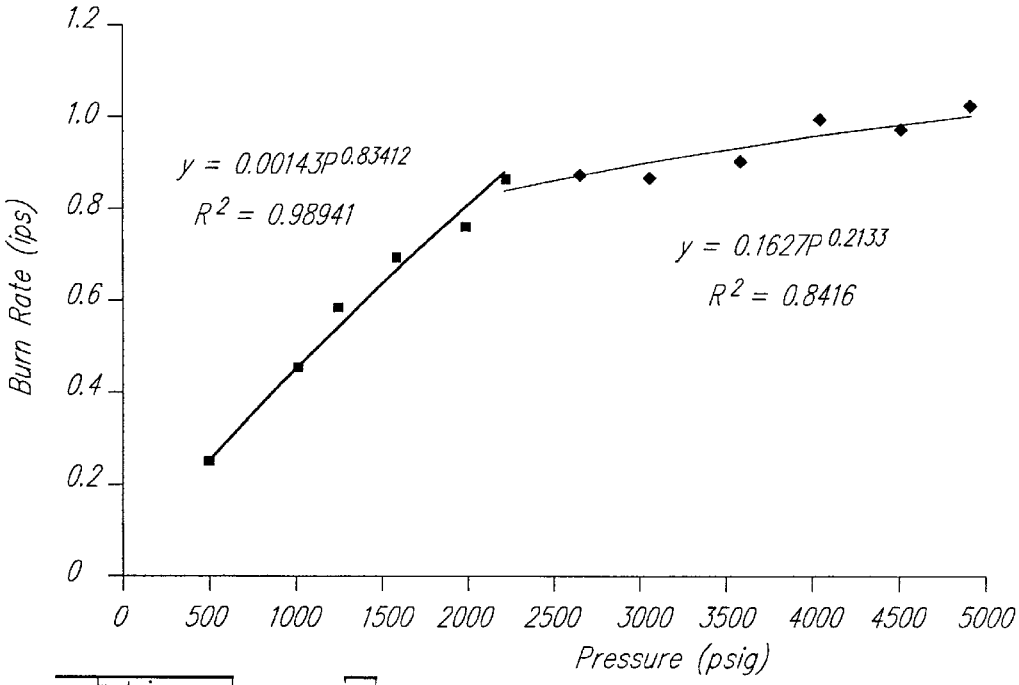
FIG. 2 represents burn rate data related to Example 6.

The composition has a burn rate at 1000 psi of 0.45 inches per second (ips). As shown in FIG. 2, the burn rate follows the equation $R_b=0.00143P^{0.834}$ from 0 psi to about 2200 psi, and $R_b=0.163P^{0.213}$ from about 2200 psi to about 5000 psi. The burn rate data demonstrate that compositions using both the primary and secondary fuels in conjunction with PSAN have both a desirable burn rate (greater than 0.40 ips at 1000 psi) and pressure exponent (less than 0.30 from about 2200–5000 psi.)

The tablets formed on the high speed press were loaded into an inflator and fired inside a 60 L tank. The ballistic performance showed an acceptable gas output and burnout time along with a low onset and slope.

EXAMPLE 7

Comparative Example

A composition was prepared containing 66.34% PSAN10, and 33.66% ADCA. Each material was dried separately at 105 degrees Celsius. The dried materials were then mixed together and tumbled with alumina cylinders in a small ball mill jar. After separating the alumina cylinders, the final product resulted in 75 grams of homogeneous and pulverized powder.

The mixture was tested using a DSC and found to melt at about 155 degrees Celsius. The composition was also tested using a TGA and found to have a 93.5% gas conversion and no mass loss until about 164 degrees Celsius. The DSC and TGA results demonstrate the excellent thermal stability and high gas yield of this composition.

Figure 3:
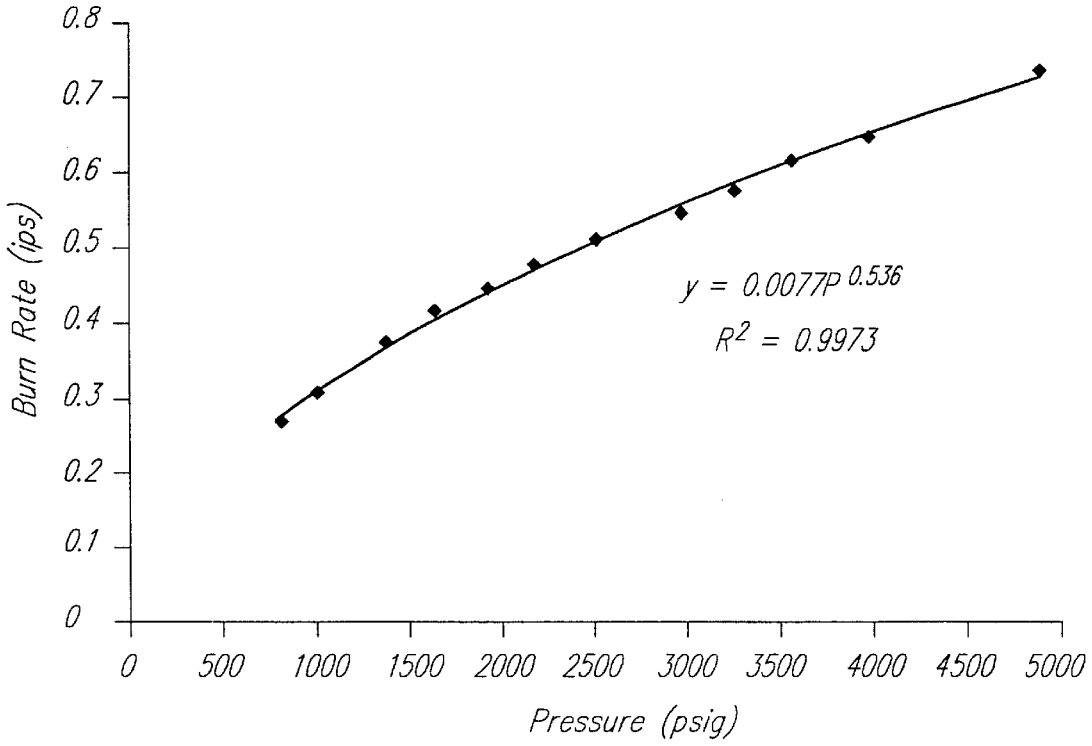
FIG. 3 represents burn rate data related to Example 7.

The composition had a burn rate at 1000 psi of 0.31 inches per second (ips). As shown in FIG. 3, the burn rate follows the equation $R_b=0.007P^{0.535}$ over the entire 0–5000 psi range. The burn rate data demonstrate that compositions using only the secondary fuel in conjunction with PSAN have an insufficient burn rate (less than 0.40 ips at 1000 psi) and an excess pressure exponent over the desired operating pressure(greater than 0.30 from about 2200–5000 psi).

Although the components of the present invention have been described in their anhydrous form, it will be understood that the teachings herein encompass the hydrated forms as well.

While the foregoing examples illustrate and describe the use of the present invention, they are not intended to limit the invention as disclosed in certain preferred embodiments herein. Therefore, variations and modifications commensurate with the above teachings and the skill and/or knowledge of the relevant art, are within the scope of the present invention.

We claim:

1. A gas generant composition useful for inflating an automotive air bag passive restraint system comprising a mixture of:

a high-nitrogen nonazide fuel selected from the class consisting of 1-, 3-, and 5-substituted amine salts of triazoles, and, 1- and 5-substituted amine salts of tetrazoles;

a second fuel selected from the group consisting of hydrazodicarbonamide and azodicarbonamide; and phase stabilized ammonium nitrate.

2. A gas generant composition as claimed in claim 1 wherein said high-nitrogen nonazide fuel is employed in a concentration of 5 to 45% by weight of the gas generant composition, said second fuel is employed in a concentration of 1 to 35% by weight of the gas generant, and, said phase stabilized ammonium nitrate is employed in a concentration of 55 to 85% by weight of the gas generant composition.

3. A gas generant composition as claimed in claim 2 further comprising an inert combination slag former, binder, processing aid, and coolant selected from the group comprising clay, diatomaceous earth, alumina, and silica wherein said slag former is employed in a concentration of 0.1 to 10% by weight of the gas generant composition.

4. A gas generant composition useful for inflating an automotive air bag passive restraint system comprising a mixture of:

a high-nitrogen nonazide fuel selected from the class consisting of 1-, 3-, 5-substituted amine salts of triazoles and 1- and 5-substituted amine salts of tetrazoles, said fuel employed in a concentration of 5 to 45% by weight of the gas generant composition;

a second fuel selected from the group consisting of hydrazodicarbonamide and azodicarbonamide, said second fuel employed in a concentration of 1 to 35% by weight of the gas generant composition; and an oxidizer consisting of phase stabilized ammonium nitrate, said oxidizer employed in a concentration of 55 to 85% by weight of the gas generant composition, wherein said fuel is selected from the group consisting of monoguanidinium salt of 5,5'-Bis-1H-tetrazole, diguanidinium salt of 5,5'-Bis-1H-tetrazole, monoaminoguanidinium salt of 5,5'-Bis-1H-tetrazole, diaminoguanidinium salt of 5,5'-Bis-1H-tetrazole , monohydrazinium salt of 5,5'-Bis-1H-tetrazole, dihydrazinium salt of 5,5'-Bis-1H-tetrazole, monoammonium salt of 5,5'-bis-1H-tetrazole, diammonium salt of 5,5'-bis-1H-tetrazole, mono-3-amino-1 ,2,4-triazolium salt of 5,5'-bis-1H-tetrazole, di-3-amino-1,2,4-triazolium salt of 5,5'-bis-1H-tetrazole, diguanidinium salt of 5,5'-Azobis-1H-tetrazole, and monoammonium salt of 5-Nitramino-1H-tetrazole.

5. A gas generant composition useful for inflating an automotive air bag passive restraint system comprising a mixture of:

a high-nitrogen nonazide fuel selected from the group consisting of tetrazoles, triazoles, salts of tetrazoles, and salts of triazoles;

a second fuel selected from the group consisting of hydrazodicarbonamide and azodicarbonamide; and phase stabilized ammonium nitrate employed in a concentration of 55–85% by weight of the gas generant composition.

6. The composition of claim 5 wherein said high-nitrogen nonazide fuel is selected from the group consisting of nitrotetrazoles and nitrotriazoles.

7. The composition of claim 6 wherein said high-nitrogen nonazide fuel is selected from the group consisting of 5-nitrotetrazole, nitroaminotriazole, and 3-nitro-1,2,4 triazole-5-one.

* * * * *